US008579113B2

(12) United States Patent
Baumgartner

(10) Patent No.: US 8,579,113 B2
(45) Date of Patent: Nov. 12, 2013

(54) TOOL CASE, IN PARTICULAR HANDHELD POWER TOOL CASE

(75) Inventor: Josef Baumgartner, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 267 days.

(21) Appl. No.: 12/833,381

(22) Filed: Jul. 9, 2010

(65) Prior Publication Data

US 2011/0005951 A1 Jan. 13, 2011

(30) Foreign Application Priority Data

Jul. 9, 2009 (DE) ..... 10 2009 027 574

(51) Int. Cl.
*A45C 11/26* (2006.01)
*F25D 3/08* (2006.01)

(52) U.S. Cl.
USPC ..... 206/349; 206/373; 62/324.1; 62/371; 62/457.1; 220/592.03

(58) Field of Classification Search
USPC ..... 206/349, 372, 373, 379; 62/3.3, 362, 62/293, 324.1, 457.1, 371; 165/58, 59, 165/104.33, 61, 63, 64; 219/201, 209, 221, 219/385, 386; 220/592.01–592.03; 320/108
See application file for complete search history.

(56) References Cited

U.S. PATENT DOCUMENTS

| | | | | |
|---|---|---|---|---|
| 3,111,166 | A * | 11/1963 | Munz et al. | 165/48.1 |
| 6,658,857 | B1 * | 12/2003 | George | 62/3.3 |
| 6,799,434 | B1 * | 10/2004 | Hobbs, Jr. | 62/457.9 |
| 6,964,179 | B2 * | 11/2005 | Yoshida | 62/457.9 |
| 7,170,035 | B2 * | 1/2007 | Peterson et al. | 219/386 |
| 7,208,700 | B2 | 4/2007 | Peterson et al. | |
| 8,061,149 | B1 * | 11/2011 | Gowans et al. | 62/3.62 |
| 2008/0035507 | A1 * | 2/2008 | Collister et al. | 206/349 |
| 2009/0250364 | A1 * | 10/2009 | Gerold et al. | 206/349 |

* cited by examiner

*Primary Examiner* — Luan K Bui
(74) *Attorney, Agent, or Firm* — Kenyon & Kenyon LLP

(57) ABSTRACT

The invention is based on a tool case, in particular a handheld power tool case, having a basic case body that has at least one storage chamber which is provided at least for receiving at least one tool and/or at least one battery unit. It is proposed that the tool case has at least one air conditioner at least partially integrated with the basic case body.

24 Claims, 2 Drawing Sheets

TOOL CASE, IN PARTICULAR HANDHELD POWER TOOL CASE

CROSS-REFERENCE TO RELATED APPLICATION

This application is based on German Patent Application 10 2009 027 574.6 filed Jul. 9, 2009.

BACKGROUND OF THE INVENTION

1. Field of the Invention

The invention is based on a tool case, in particular a handheld power tool case, having a basic case body that has at least one storage chamber intended at least for receiving at least one tool and/or at least one battery unit.

2. Description of the Prior Art

Handheld power tool cases are already known, having a basic case body which has a storage chamber that is intended for receiving a handheld power tool, handheld power tool battery units, and tool inserts.

ADVANTAGES AND SUMMARY OF THE INVENTION

It is proposed that the tool case has at least one air conditioner at least partially integrated with the basic case body. The term "basic case body" should be understood in particular to mean one or more shell-shaped bodies, which define the storage chamber, and/or a cap that defines the storage chamber and is intended for closure of a shell-shaped body. The basic case body is preferably embodied as a unit that is portable by a person and that preferably without its contents weighs less than 50 kg and in particular less than 20 kg. The term "air conditioner" should be understood in particular to mean a device that is intended or provided in particular for varying the temperature and/or humidity inside the storage chamber, especially actively, that is, by using energy, in particular electrical energy, and/or by utilizing an aggregate status change. The term "intended or provided" should be understood to mean especially designed, equipped, and/or especially programmed. Moreover, "integrated" should be understood in particular to mean that at least part of the air conditioner, at least in one operating state, is connected in captive fashion and/or solidly to the basic case body, embedded at least partially in the basic case body, and in particular spray-coated, and/or at least partially in one piece with the basic case body. By means of a suitable design, conditions for the tool stored and/or transported in the storage chamber can advantageously be improved. The invention is especially suitable for cordless tool cases that are intended for storing and/or transporting at least one battery unit, in particular at least one handheld power tool battery unit, as a result of which, in a structurally simple way, especially advantageous conditions for the handheld power tool battery unit can be attained and its performance can be improved. Moreover, heat dissipation in charging operations for battery units can advantageously be attained while the battery units are being transported in the tool case.

In a further feature of the invention, it is proposed that the air conditioner has at least one energy supply unit, which is intended for supplying energy to at least one unit of the air conditioner or in other words is especially equipped and/or designed. The term "energy supply unit" should be understood in this connection to mean in particular a unit for carrying current, for converting current and/or voltage, such as direct current to alternating current and vice versa, for storing electrical energy, for monitoring a charge status, and/or for mounting one of the aforementioned units. Preferably, the energy supply unit is at least partly integrated with the basic case body, or in other words at least partly solidly connected to the basic case body, at least partly reshaped and for instance in particular spray-coated by it, and/or at least partly embodied in one piece with the basic case body. By means of a suitable design, an energy supply to the air conditioner can be ensured in a structurally simple way.

If the energy supply unit includes at least one charging unit, the flexibility of use can advantageously be enhanced. The charging unit can be intended preferably for charging a handheld power tool battery and/or for charging a battery of the air conditioner.

In a further feature of the invention, it is proposed that an energy supply unit have at least one energy transmission unit for cordless energy transmission. The term "energy transmission unit for cordless energy transmission" should be understood in particular to mean a unit which is intended for transmitting electrical energy over at least some distance without physical current-carrying lines. Various methods that appear useful to one skilled in the art, but especially advantageously inductive methods, are conceivable in this respect. By means of this kind of energy transmission unit, especially flexible energy transmission that is not vulnerable to soiling can be attained. The energy transmission unit can be provided for transmitting energy between various parts of the air conditioner, for instance in particular between an energy supply unit of the air conditioner and an energy consumption unit, such as a heating element, a cooling element, a fan unit, and/or a control and/or regulating unit, of the air conditioner in particular, and/or can be provided for transmitting energy into the tool case.

If the energy supply unit has a connection unit, which connects a battery storage chamber of the basic case body in terms of energy to a further part of the air conditioner, in particular to a connection point of the air conditioner and/or of an energy consumption unit of the air conditioner, for instance, then rechargeable batteries of a handheld power tool can advantageously be used to supply energy to the air conditioner. The connection unit is advantageously at least partly integrated with the basic case body, or in other words in particular connected at least partially solidly to it, reshaped by it, for instance spray-coated, and/or partly embodied in one piece with it.

In a further feature of the invention, it is proposed that the tool case has a thermal insulation unit, which is provided for thermal insulation of the basic case body. The term "thermal insulation unit" should be understood in particular to mean a unit which at least partly comprises a material that has a coefficient of thermal conduction which, under comparable conditions, is less, and in particular multiple times less, than a coefficient of thermal conduction of a wall material of the tool case. By means of such a design, advantageous conditions can be maintained over a long period of time at little expenditure of energy.

If the air conditioner has at least one heating element, then undesirably low temperatures in the storage chamber can advantageously be avoided; if the air conditioner has at least one cooling element, then undesirably high temperatures in the storage chamber can advantageously be avoided. Both the heating elements and the cooling elements can be formed by various elements that appear useful to one skilled in the art, such as, especially advantageously, by a heat pipe, which for cooling uses effects of an aggregate status change in particular, and/or especially advantageously by a Peltier cooler.

It is also proposed that the air conditioner has at least one fan unit. The term "fan unit" should be understood in particular to mean a unit which generates a gas flow, in particular an air flow, for cooling and/or heating purposes. With a suitable design, high efficiency can be attained in a structurally simple way. The fan unit may be intended solely for air conditioning the storage chamber, or it may also have additional functions and in particular may be embodied in one piece with a different function unit, such as a suction unit and/or a handheld power tool. In particular, a fan of a handheld power tool can be used for air conditioning the storage chamber. A suitable design makes economies possible with regard to additional components, space, weight, assembly effort, and costs.

If the air conditioner has at least one climate sensor unit, then useful parameters can advantageously be obtained. The term "climate sensor unit" should be understood in particular to mean a unit that is intended for detecting at least one humidity parameter and/or in particular at least one temperature parameter. The parameters obtained can be used for information to a user, for instance by outputting them via an output unit, and/or can advantageously be used for at least partly automated control and/or regulation. To that end, the air conditioner has at least one control and/or regulating unit. The term "control and/or regulating unit" should be understood in particular to mean a unit which has an arithmetic unit, a memory unit, and an operating program stored in the memory unit. The climate sensor unit and/or the control and/or regulating unit can in turn be intended solely for the air conditioner or can have additional functions and in particular can be embodied integrally with some other function unit, such as a unit of the handheld power tool in particular.

Especially advantageously, in a cordless tool case, which is intended in particular for receiving at least one handheld power tool battery unit and preferably at least one cordless handheld power tool, the temperature in the storage chamber is regulated to a value of between +5° C. and 35° C.

BRIEF DESCRIPTION OF THE DRAWINGS

The invention will be better understood and further advantages thereof will become more apparent from the ensuing detailed description of a preferred embodiment taken in conjunction with the drawings, in which.

DESCRIPTION OF THE PREFERRED EMBODIMENT

Figure 1:
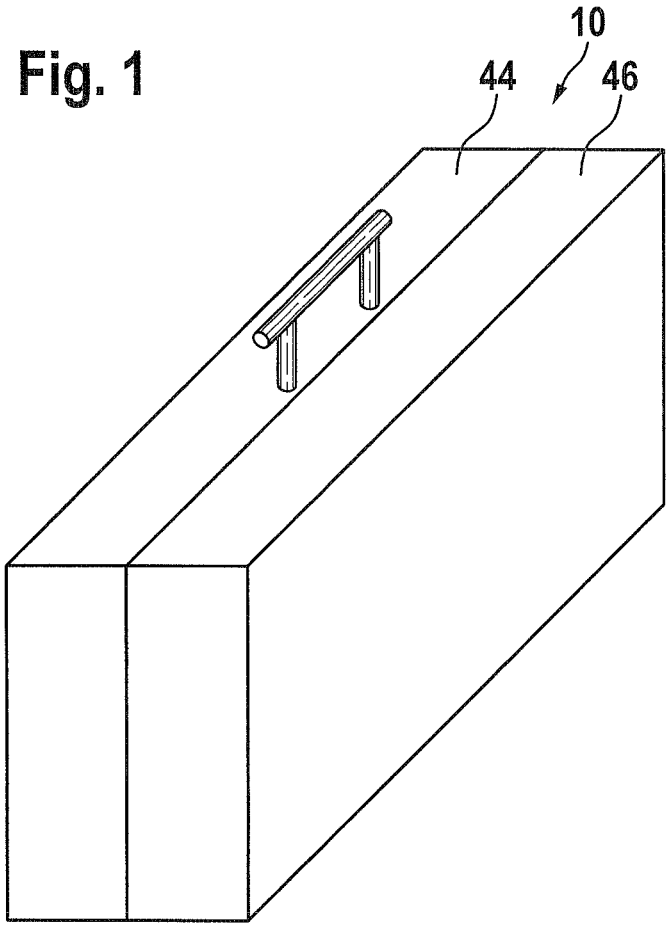
FIG. 1 is a schematic illustration of a closed handheld power tool case, obliquely from above.
Figure 2:
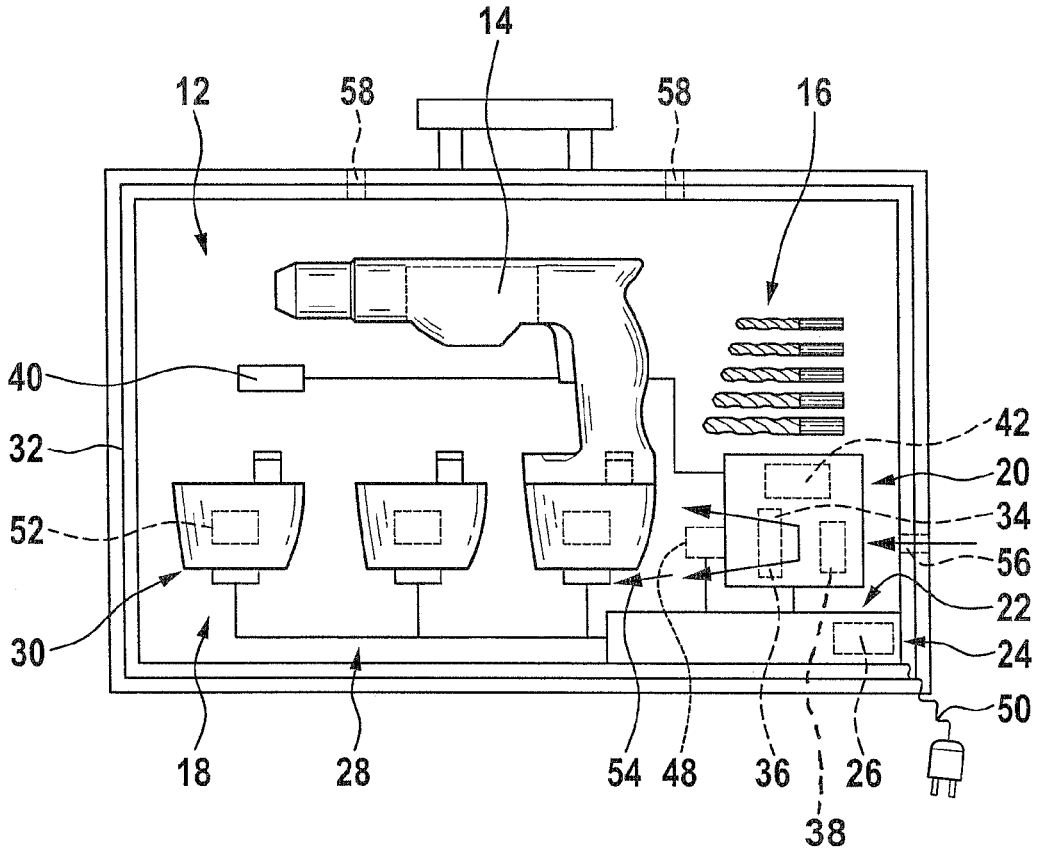
FIG. 2 is a schematic illustration of the open handheld power tool case.

FIG. 1 shows a schematic view of a closed handheld power tool case, specifically a cordless handheld power tool case for transporting a tool 14 shown in FIG. 2, embodied as a cordless handheld power tool, tool inserts 16 belonging to it, and handheld power tool battery units 18. The handheld power tool case has a basic case body 10, which includes two shell bodies 44, 46 and has a storage chamber 12, which is bounded by the shell bodies 44, 46 and is intended for receiving the cordless handheld power tool 14, the tool inserts 16, and the handheld power tool battery units 18. The handheld power tool case has an air conditioner 20, integrated with the basic case body 10, or in other words in particular solidly disposed on it.

The air conditioner 20 has an energy supply unit 22, which is provided for supplying energy to the air conditioner 20. The energy supply unit 22 includes a charging unit 24, which is intended for charging the handheld power tool battery units 18 and for charging a rechargeable battery 48 of the air conditioner 20. The energy supply unit 22 moreover has a connection unit 28, which includes electric cords and is integrated with the basic case body 10 or in other words is solidly disposed on it, and which in terms of energy connects a battery storage chamber 30 of the basic case body 10, which chamber is intended for receiving the handheld power tool battery units 18, to the charging unit 24 and to the rechargeable battery 48 of the air conditioner 20.

If the charging unit 24 is connected to a power grid by means of a power cable 50 of the charging unit 24, then the handheld power tool battery units 18 and the rechargeable battery 48 of the air conditioner 20 can be charged via the connection unit 28, and the air conditioner 20 can be operated with electrical energy from the power grid. If the power cable 50 is disconnected from the power grid, the air conditioner 20 is supplied with electrical energy from the rechargeable battery 48 and/or from the handheld power tool battery units 18, depending on the charge state at the time. Alternatively, the air conditioner 20, without a connection to the power grid, could be supplied with energy solely from the rechargeable battery 48 or solely from the handheld power tool battery units 18, as a result of which the additional battery 48 could be dispensed with. The energy supply unit 22 has a current and voltage conversion unit, so that it can be connected to power grids and/or energy storage means having direct current and alternating current as well as different voltages.

Besides the power cable 50, the energy supply unit 22 has an energy transmission unit 26 for cordless energy transmission, specifically for inductive energy transmission. By means of the energy transmission unit 26, electrical energy from an energy transmission unit, not shown in further detail, located outside the handheld power tool case can be transmitted in cordless fashion into the handheld power tool case, specifically for charging the handheld power tool battery units 18 and the rechargeable battery 48 and for operating the air conditioner 20.

The air conditioner 20 has a heating element 34, a cooling element 36 formed by a Peltier cooler, and a fan unit 38. In addition or alternatively to the cooling element 36 formed by a Peltier cooler, heat pipe elements 52 may also be provided, as indicated in FIG. 2. The heat pipe elements 52 could preferably be coupled to the handheld power tool battery units 18 via a connection which has an advantageous thermal conduction for dissipating the heat from the handheld power tool battery units 18, for instance in particular via a connection which is intended to enable continuous material heat dissipation from the handheld power tool battery units 18 to the heat pipe elements 52.

In a heating mode, the heating element 34 is activated, and for generating an air flow 54, air from an external region of the handheld power tool case is aspirated by the fan unit 38 through air inlets 56 in the basic case body and blown into the storage chamber 12 via the heating element 34. In a cooling mode, the cooling element 36 is activated, and air from an external region of the handheld power tool case is aspirated by the fan unit 38 through the air inlets 56 and blown into the storage chamber 12 via the cooling element 36. To avoid an overpressure in the basic case body 10 when the basic case body 10 is closed and for advantageously making air conditioning possible when the basic case body 10 is closed, vent recesses 58 provided in the basic case body 10.

In order to establish an advantageous temperature between +10° C. and 30° C. in the storage chamber 12 at all times in an automated fashion, the air conditioner 20 has a climate sensor unit 40 for detecting a temperature variable of a prevailing temperature in the storage chamber 12 and also has a control and regulating unit 42, which is intended for performing automated control and regulation as a function of parameters of the climate sensor unit 40. The control and regulating unit 42 regulates the temperature in the storage chamber to a value of between +10° C. and +30° C. As a function of the prevailing temperature in the storage chamber 12, the heating element 34 or the cooling element 36 as well as the fan unit 38 are activated by the control and regulating unit 42.

In order to maintain a desired temperature inside the storage chamber 12 over a long period of time as much as possible without active air conditioning, the handheld power tool case has a thermal insulation unit 32, which is intended for thermal insulation of the basic case body 10 and is disposed inside, in other words on a side toward the storage chamber 12, of walls of the basic case body 10.

The foregoing relates to a preferred exemplary embodiment of the invention, it being understood that other variants and embodiments thereof are possible within the spirit and scope of the invention, the latter being defined by the appended claims.

I claim:

1. A tool case comprising:

a handheld power tool;

at least one power tool battery unit, the at least one power tool battery unit electrically connectable to the power tool;

a basic case body that has at least one storage chamber which is provided at least for receiving the power tool and the at least one power tool battery unit;

at least one air conditioner at least partially integrated with the basic case body; and at least one energy supply unit, the at least one energy supply unit being configured to supply energy to the at least one air conditioner;

wherein the at least one energy supply unit includes a connection unit configured to releasably connect the at least one power tool battery unit in the at least one storage chamber to the at least one air conditioner such that the at least one air conditioner is powered by the at least one power tool battery unit.

2. The tool case as defined by claim 1, wherein the at least one energy supply unit is provided for supplying energy to the air conditioner.

3. The tool case as defined by claim 2, wherein the energy supply unit includes at least one charging unit configured to charge the at least one power tool battery unit.

4. The tool case as defined by claim 2, wherein the energy supply unit has at least one energy transmission unit for cordless energy transmission configured to transmit electrical energy inductively from an energy transmission unit located outside the tool case into the tool case.

5. The tool case as defined by claim 3, wherein the energy supply unit has at least one energy transmission unit for cordless energy transmission configured to transmit electrical energy inductively from an energy transmission unit located outside the tool case into the tool case.

6. The tool case as defined by claim 2, wherein the connection unit connects a battery storage chamber of the basic case body in terms of energy to a further part of the air conditioner.

7. The tool case as defined by claim 3, wherein the connection unit connects a battery storage chamber of the basic case body in terms of energy to a further part of the air conditioner.

8. The tool case as defined by claim 4, wherein the connection unit connects a battery storage chamber of the basic case body in terms of energy to a further part of the air conditioner.

9. The tool case as defined by claim 5, wherein the connection unit connects a battery storage chamber of the basic case body in terms of energy to a further part of the air conditioner.

10. The tool case as defined by claim 1, further having a thermal insulation unit, which is provided for thermal insulation of the basic case body.

11. The tool case as defined by claim 9, further having a thermal insulation unit, which is provided for thermal insulation of the basic case body.

12. The tool case as defined by claim 1, wherein the air conditioner has at least one heating element.

13. The tool case as defined by claim 11, wherein the air conditioner has at least one heating element.

14. The tool case as defined by claim 1, wherein the air conditioner has at least one cooling element.

15. The tool case as defined by claim 13, wherein the air conditioner has at least one cooling element.

16. The tool case as defined by claim 1, wherein the air conditioner has at least one fan unit.

17. The tool case as defined by claim 1, wherein the air conditioner has at least one climate sensor unit.

18. The tool case as defined by claim 17, wherein the air conditioner has at least one control and/or regulating unit, which is provided for performing a control and/or regulating unit, in at least partly automated fashion, as a function of at least one parameter detected by the at least one climate sensor unit.

19. The tool case as defined by claim 1, wherein the at least one air conditioner has at least one heating element, at least one cooling element, at least one fan unit, and at least one climate sensor unit, and wherein the at least one heating element, the at least one cooling element, and the at least one fan unit are at least one of (i) controlled and (ii) regulated by the at least one climate sensor unit.

20. The tool case as defined by claim 3, wherein the connection unit is electrically connected to the charging unit.

21. The tool case as defined by claim 1, further comprising:

at least one rechargeable battery for providing power to the at least one air conditioner.

22. The tool case as defined by claim 21, wherein the at least one rechargeable battery is charged via the connection unit.

23. The tool case as defined by claim 17, wherein the at least one climate sensor unit is integral with the at least one tool.

24. A tool case comprising:

a basic case body that has at least one storage chamber which is provided to receive at least one tool and/or at least one power tool battery unit;

at least one air conditioner at least partially integrated with the basic case body;

at least one energy supply unit; and a connection unit, wherein the connection unit connects the at least one power tool battery unit in the at least one storage chamber to the at least one air conditioner such that the at least one air conditioner is powered by the at least one power tool battery unit, wherein the air conditioner has at least one climate sensor unit, wherein the at least one climate sensor unit is integral with the at least one tool.

* * * * *